US010618189B2

(12) United States Patent
Klaiber et al.

(10) Patent No.: US 10,618,189 B2
(45) Date of Patent: Apr. 14, 2020

(54) DISC CUTTING MACHINE HAVING A HOLDER FOR MATERIAL TO BE CUT

(71) Applicant: Bizerba SE & Co. KG, Balingen (DE)

(72) Inventors: Christoph Klaiber, Gomaringen (DE); Thanh-Huy Truong, Rottweil (DE); Andrej Fahnenstiel, Balingen (DE); Jens Schmon, Messkirch-Langenhart (DE); Stefan Follner, Echterdingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/114,239

(22) Filed: Aug. 28, 2018

(65) Prior Publication Data

US 2019/0061195 A1 Feb. 28, 2019

(30) Foreign Application Priority Data

Aug. 30, 2017 (EP) ..... 17188565

(51) Int. Cl.
*B26D 7/06* (2006.01)
*B26D 5/08* (2006.01)
(Continued)

(52) U.S. Cl.
CPC ..... *B26D 7/0616* (2013.01); *B26D 3/162* (2013.01); *B26D 5/086* (2013.01); *B26D 7/265* (2013.01);
(Continued)

(58) Field of Classification Search
CPC .... B26D 7/0616; B26D 7/265; B26D 7/2621; B26D 2210/02
See application file for complete search history.

(56) References Cited

U.S. PATENT DOCUMENTS 1,739,697 A * 12/1929 Van Berkel ..... B26D 7/0616 83/730
2,187,312 A * 1/1940 Goodlake ..... B26D 7/0616 108/7
(Continued)

FOREIGN PATENT DOCUMENTS

DE 1433283 U 12/1938
DE 935347 C 11/1955
(Continued)

*Primary Examiner* — Jose V Chen
(74) *Attorney, Agent, or Firm* — Leydig, Voit & Mayer, Ltd.

(57) ABSTRACT

An electrically powered disc cutting machine for cutting off discs from in particular elongate material to be cut, preferably food, includes: a cutting device having a circular blade that rotates in a cutting plane about an axis of rotation perpendicular to the cutting plane and is driven by a blade motor. The cutting device includes: a carriage for carrying a carriage plate in a carriage plane perpendicular to the cutting plane and to carry at least one carriage wall that protrudes from the carriage plane; and a holder for material to be cut, the holder having a bearing surface for receiving the material to be cut and for bringing the material to be cut closer to the circular blade at an angle $\alpha<90°$ relative to the cutting plane. The holder for material to be cut includes a fastening apparatus for fastening the holder for material to be cut.

20 Claims, 4 Drawing Sheets

(51) Int. Cl.

| | |
|---|---|
| ***B26D 7/26*** | (2006.01) |
| ***B26D 3/16*** | (2006.01) |
| *B26D 1/15* | (2006.01) |
| *B26D 1/153* | (2006.01) |

(52) U.S. Cl.
CPC ..... *B26D 1/15* (2013.01); *B26D 1/153* (2013.01); *B26D 7/2621* (2013.01); *B26D 2210/02* (2013.01)

(56) References Cited

U.S. PATENT DOCUMENTS 4,379,416 A * 4/1983 Kuchler ..... B26D 5/00 83/23
4,397,206 A * 8/1983 Czala ..... B26D 7/0616 83/399
4,543,868 A * 10/1985 Maurer ..... B26D 7/01 269/54
4,817,480 A * 4/1989 Young ..... B26D 7/12 451/419
5,862,730 A * 1/1999 Cartwright ..... B26D 5/00 192/143
2006/0185491 A1* 8/2006 Graef ..... B26D 7/01 83/651
2008/0190305 A1* 8/2008 Zhu ..... B26D 7/0616 99/537
2008/0271584 A1* 11/2008 Repaci ..... B26D 7/01 83/471
2009/0211417 A1* 8/2009 Rummel ..... B26D 5/00 83/74
2010/0089254 A1* 4/2010 Gosis ..... B26D 1/143 99/537
2012/0222533 A1* 9/2012 Koch ..... B26D 7/225 83/435.11
2013/0298741 A1* 11/2013 Zhu ..... B26D 7/225 83/435.11
2017/0106557 A1* 4/2017 Capone ..... B26D 7/30
2017/0232629 A1* 8/2017 McGuffin-Noll ..... B26D 7/01 83/730
2018/0085966 A1* 3/2018 Schmidt ..... B26D 1/143
2018/0169886 A1* 6/2018 Endress ..... B26D 7/2635
2018/0304487 A1* 10/2018 Richter ..... B26D 7/32
2018/0311857 A1* 11/2018 Koch ..... B26D 7/32

FOREIGN PATENT DOCUMENTS

DE 1037909 B 8/1958
DE 4434364 A1 3/1996
EP 3342566 A1 7/2018

* cited by examiner

DISC CUTTING MACHINE HAVING A HOLDER FOR MATERIAL TO BE CUT

CROSS-REFERENCE TO PRIOR APPLICATION

Priority is claimed to European Patent Application No. 17 188 565.0, filed on Aug. 30, 2017, the entire disclosure of which is hereby incorporated by reference herein.

FIELD

The invention relates to an electrically powered disc cutting machine for cutting off discs from in particular elongate material to be cut, preferably food, comprising a cutting device having a circular blade that rotates in a cutting plane about an axis of rotation perpendicular to the cutting plane and is driven by a blade motor, comprising a carriage that carries a carriage plate in a carriage plane perpendicular to the cutting plane and carries at least one carriage wall that protrudes from the carriage plane, and comprising a holder for material to be cut, said holder having a bearing surface for receiving the material to be cut and being designed to bring the material to be cut closer to the circular blade at an angle $\alpha<90°$ relative to the cutting plane.

BACKGROUND

A disc cutting machine of this kind is known from U.S. Pat. No. 2,187,312.

Disc cutting machines of this type allow the material to be cut obliquely. The material to be cut can be cut obliquely at the angle $\alpha$, e.g. at 45°, to the longitudinal direction of the material to be cut perpendicular plane. For elongate or cylindrical material to be cut, therefore, oval discs, which have a larger surface area than circular discs, can be cut off on a disc cutting machine of this kind.

In principle, even if there is no holder for the material to be cut, said material could be cut obliquely by being placed on the carriage plate in an accordingly oblique manner or being held obliquely thereon. However, this creates very high risks of injury for disc cutting machine users.

In the disc cutting machine described in U.S. Pat. No. 2,187,312, cited at the outset, a holder for material to be cut in the form of a support is secured to the carriage plate by means of a screw clamp. The bearing surface of the holder for material to be cut can be tilted relative to the horizontal by means of a crank mechanism such that said surface forms a support surface, extending obliquely downwards, for the material to be cut.

The drawback of this solution is that the use of the holder for material to be cut described in said document is restricted to just a few types of disc cutting machines. For example, the screw clamp often cannot be properly secured to the carriage plate due to the lack of a free surface.

SUMMARY

In an embodiment, the present invention provides an electrically powered disc cutting machine for cutting off discs from in particular elongate material to be cut, preferably food, comprising: a cutting device having a circular blade configured to rotate in a cutting plane about an axis of rotation perpendicular to the cutting plane and to be driven by a blade motor, the cutting device comprising: a carriage configured to carry a carriage plate in a carriage plane perpendicular to the cutting plane and to carry at least one carriage wall that protrudes from the carriage plane; and a holder for material to be cut, the holder having a bearing surface configured to receive the material to be cut and being configured to bring the material to be cut closer to the circular blade at an angle $\alpha<90°$ relative to the cutting plane, wherein the holder for material to be cut comprises a fastening apparatus configured to fasten the holder for material to be cut to the carriage wall in an exact fit, the fastening apparatus being configured such that the holder for material to be cut is securable in a defined, reproducible position relative to the carriage wall.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
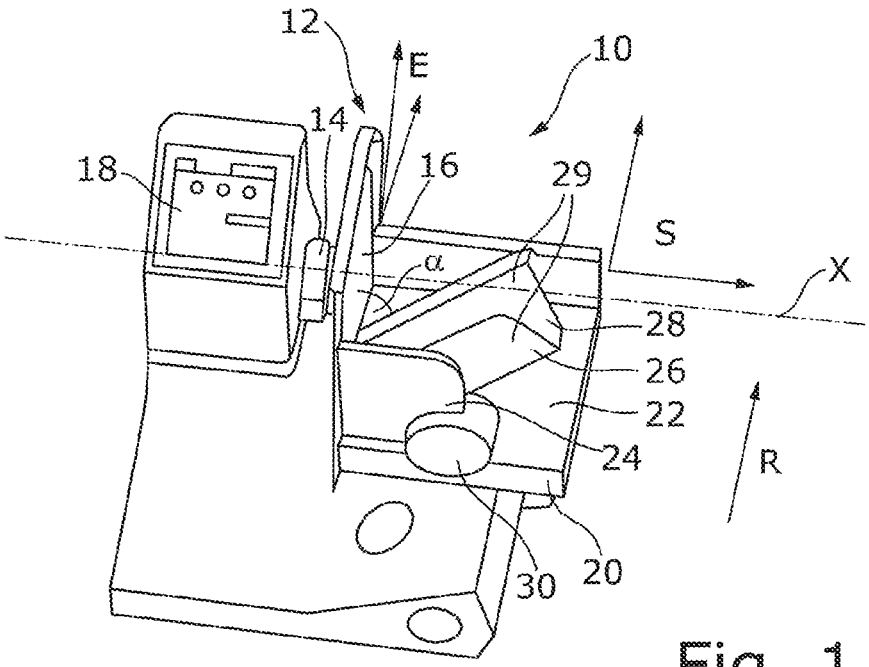
FIG. 1 is a perspective view of an embodiment of the disc cutting machine according to the invention, formed as a vertical cutter and comprising a holder for material to be cut fitted on a carriage.

Against this background, the object of the invention is to improve a generic disc cutting machine in a cost-effective manner using readily available technical means, and in particular to disclose a reproducible, operationally safe, electrically powered disc cutting machine that cuts obliquely and can be used for many applications.

This object is solved particularly simply in technical terms and surprisingly effectively by a generic electrically powered disc cutting machine in which the holder for material to be cut comprises a fastening apparatus for fastening the holder for material to be cut to the carriage wall in an exact fit, the fastening apparatus being designed such that the holder for material to be cut can be secured in a defined, reproducible position relative to the carriage wall.

Therefore, the holder for material to be cut can be secured to the side wall of the disc cutting machine to the necessary level of precision and reproducibility. To do so, no particular geometric design of the carriage plate is required. The holder for material to be cut can be secured to substantially any available disc cutting machine, as long as the carriage thereof comprises a carriage wall. Consequently, due to the modular nature of the disc cutting machine according to the invention, practically any existing disc cutting machine can be retrofitted in a simple manner to become a disc cutting machine according to the invention or converted into such a machine. As a result, there is generally no need for any further adaptations to the disc cutting machine before the holder for material to be cut is attached.

In a particularly preferred group of embodiments of the fastening apparatus according to the invention, the design thereof can be selected such that the holder for material to be cut can be fastened to the carriage wall in a reversible manner that is reproducible during operation in terms of the relative position of the holder for material to be cut to the carriage wall, and such that the holder for material to be cut can be removed from the carriage wall. As a result, it is relatively simple to meet the particularly stringent hygiene requirements especially in the field of food processing since the holder for material to be cut can be fitted and detached in a particularly simple and reversible manner. For example, the detached holder for material to be cut can be cleaned and/or disinfected separately from the rest of the disc cutting machine, for example in a dishwasher, thereby making it significantly simpler to meet the stringent hygiene requirements.

In advantageous developments, the fastening apparatus can be designed in particular such as to allow the holder for material to be cut to be fastened in different, selectable relative positions of the holder for material to be cut to the carriage wall such that it is possible to set different angles at which the material being cut can be brought closer to the circular blade obliquely to the axis of rotation. The angle at which the disc is cut and therefore the shape and size of the cut-off discs can thus be adjusted.

In developments, the fastening apparatus can also comprise a clamping portion for the reversible and reproducible fastening, in particular by way of a press fit by means of a clamping screw, preferably a knurled thumb screw. By means of this clamping screw, therefore, the fastening apparatus can be fixed to the carriage wall, together with the rest of the holder for material to be cut, in a simple and accurate manner by actuating the clamping portion, in particular by tightening the clamping screw.

In embodiments of the invention in which the holder for material to be cut can be fastened to the carriage wall without using tools, the fitting and/or detachment are particularly simple. To this end, the aforementioned clamping screw can comprise an actuating head, for example.

In a particularly advantageous embodiment, the holder for material to be cut, in particular the bearing surface for receiving said material, comprises one or more devices for securing the material to be cut relative to the bearing surface for said material, for example in the form of one or more steadies. As a result, the material to be cut can be securely held in the holder for said material.

This may be particularly important for oblique cutters. Similarly to vertical cutters, ex works oblique cutters also cut discs at a right angle from the material to be cut. However, unlike vertical cutters, the axis of rotation of the circular blade, and thus the carriage plate, of oblique cutters are tilted relative to the horizontal for this purpose. If a holder for material to be cut is now mounted on an oblique cutter, thereby potentially further increasing the tilt of the material to be cut relative to the horizontal, the material to be cut can be prevented from overfilling by the securing devices. This can also considerably improve operational safety since the material to be cut no longer has to be held manually for oblique cuts and users will not be "tempted" to hold the material to be cut with their hand.

Often, the carriage comprises a plurality of carriage walls, in particular a front carriage wall located at the front in the feed direction and a rear carriage wall located at the rear in the feed direction. In that case, the fastening apparatus for fastening the holder for material to be cut in an exact fit can be attached to a rear carriage wall arranged behind the axis of rotation in the cutting direction. During the disc cutting, therefore, the fastening apparatus has to dissipate substantially only compression forces into the carriage wall instead of tensile forces.

The lateral holding for typical elongate material to be cut can be improved by making the bearing surface of the holder for said material, which surface is intended for receiving the material to be cut, trough-shaped, in particular by giving said surface a U-shaped or V-shaped cross section.

In particularly simple and cost-effective embodiments of the invention, the holder for material to be cut or at least the bearing surface thereof for receiving said material can be made of shaped sheet metal.

In preferred developments to these embodiments, the holder for material to be cut or at least the bearing surface thereof can in particular be formed in one piece.

In a particularly preferred embodiment, the fastening apparatus is rigidly connected to the rest of the holder for material to be cut, in particular to the bearing surface.

In further embodiments, the bearing surface for receiving the material to be cut can alternatively or additionally comprise at least one movable wall portion that is adjustable, in particular tiltable and/or displaceable. The bearing surface can then be adapted to the geometry of the material to be cut.

In preferred developments, the movable wall portion can be designed in particular such that the geometry of the bearing surface can be adapted to the cross section of the material being cut at that time.

A further improvement can be achieved by embodiments of the invention in which the holder for material to be cut comprises a securing apparatus for securing an element of the carriage, in particular a scraps holder. Typically, the carriage usually has additional elements such as a scraps holder that are not necessarily needed or at least not used when the holder for material to be cut is being used. By means of the securing apparatus, these additional elements can be secured such as to not hinder the operation of the disc cutting machine together with the holder for material to be cut.

In developments, the scraps holder can for this purpose be secured when it is in a particular position on a rail intended for sliding the scraps holder. This can be achieved in particular by designing the securing apparatus accordingly. For example, the securing apparatus may comprise a clamping arm that can be used to hold the scraps holder in a desired position.

The disc cutting machine according to the invention can be formed as a vertical cutter or an oblique cutter. In particular, it is conceivable for both vertical and oblique cutters to be able to be equipped with and used together with the embodiments of holders for material to be cut described above and below, even if a particular embodiment of a holder for material to be cut was only described (or practical) in relation to one type of disc cutting machine.

Since, as explained above, the holder for material to be cut according to the invention can be used in a variety of disc cutting machines, it is even conceivable for the holder for material to be cut to be used separately from a specific disc cutting machine. For example, the holder for material to be cut can be used as an in particular modular accessory part and/or retrofitted part.

In another group of embodiments of the invention, the holder for material to be cut can alternatively or additionally be oriented in a plane that is perpendicular to the cutting plane E (so in an at least substantially horizontal plane in vertical cutters) at an angle ß. As a result, the initial cut to the material being cut can also be made obliquely by positioning said material in an oblique manner relative to the circular blade, for example in the at least substantially horizontal plane. To do so, an adjustable and/or variable joint can be provided on the fastening apparatus and can be used to rotate the bearing surface relative to the fastening apparatus in the at least substantially horizontal plane.

To meet hygiene requirements, it can also be provided for the material being cut to only come into contact with planar or at least substantially planar surfaces, in particular surfaces of the holder for material to be cut. Other surfaces and/or elements such as screws, gaps, etc. may be designed or positioned away from the site where the material to be cut is intended to be placed, preferably within the original construction.

Further features and advantages of the invention can be found in the following detailed description of an embodiment on the invention given on the basis of the figures of the drawings, which show the essential features of the invention, and in the claims. In variants on the invention, the individual features can be implemented either in isolation or together in any combination.

To aid understanding of the invention, matching reference signs will be used for corresponding elements wherever possible in the following, although elements from alternative embodiments will be denoted by an apostrophe.

FIG. 1 shows a first embodiment of an electrically powered disc cutting machine 10 according to the invention for cutting off discs from in particular elongate material to be cut, preferably food. In this embodiment, the disc cutting machine 10 is formed as a vertical cutter.

It is equipped with a cutting device 12 comprising a circular blade 16 that rotates in a cutting plane E about an axis of rotation X perpendicular to the cutting plane E and is driven by a blade motor 14. The disc cutting, and in particular the blade motor 14, are controlled and monitored by means of an input and control unit 18.

In addition, the disc cutting machine 10 comprises a carriage 20 that carries a carriage plate 22 in a carriage plane S perpendicular to the cutting plane E and carries at least one carriage wall 24 that protrudes from the carriage plane E, and comprises a holder 26 for material to be cut that has a bearing surface 28 having bearing surface side faces 29 for receiving the material to be cut and is designed to bring the material to be cut closer to the circular blade 16 at an angle $\alpha<90°$ relative to the cutting plane E.

The holder 26 for material to be cut comprises a fastening apparatus 30 for fastening said holder 26 to the carriage wall 24 in an exact fit.

To cut the discs, the carriage 20 is moved in a cutting direction R. As a result, the carriage wall 24 to which the holder 26 for material to be cut is secured according to FIG. 1 is a rear carriage wall of the carriage 20 when viewed in the cutting direction R.

Figure 2:
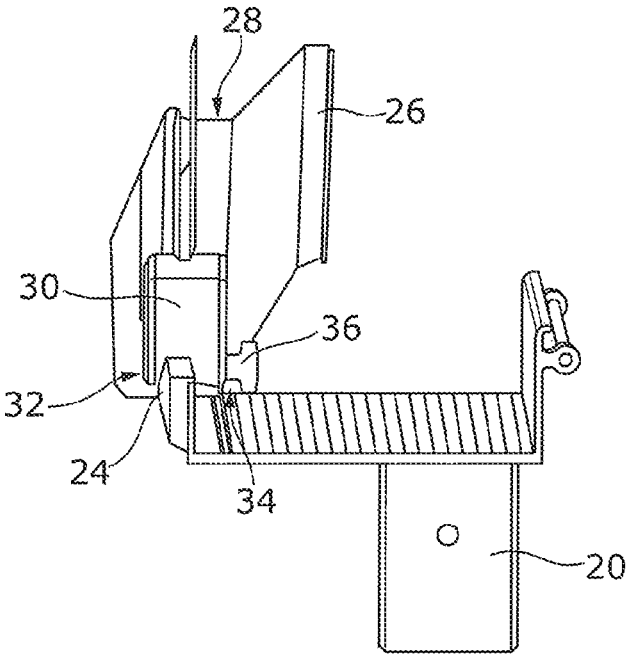
FIGS. 2 and 3 are perspective views of the carriage together with the holder for material to be cut from FIG. 1.
Figure 3:
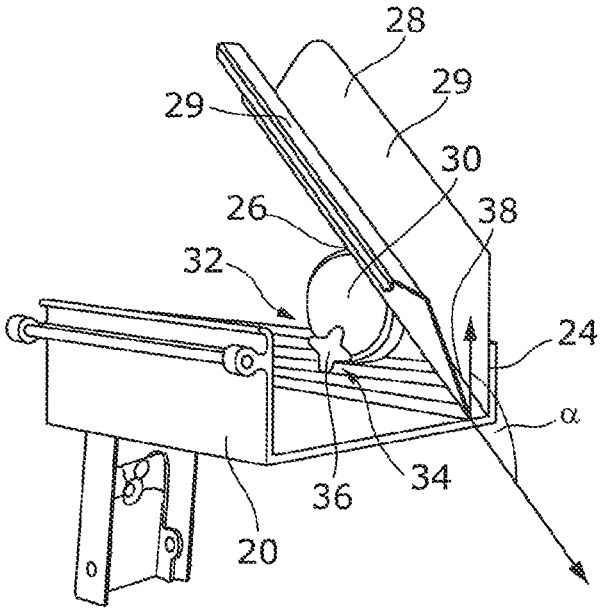

FIGS. 2 and 3 are perspective views of the carriage 20 together with the holder 26 for material to be cut from FIG. 1 arranged on the carriage wall 24 of said carriage. FIG. 3 shows the carriage 20 in a perspective view when viewed from the circular blade 16 (see FIG. 1). In this case, FIG. 3 only shows part of the carriage wall 24 for illustrative purposes.

The fastening apparatus 30 comprises a clamping portion 32 having a clamping screw 34 in the form of a knurled thumb screw.

By means of the clamping screw 34, the holder 26 for material to be cut can be fastened to the carriage wall 24 in a reversible and reproducible manner, in particular can be clamped thereto by means of a press fit. To do so, it is sufficient to actuate or rotate an actuating head 36 of the clamping screw 34 accordingly. As a result, the holder 26 for material to be cut can be fastened to the carriage wall 24 without using tools.

The fastening apparatus 30 can thus be reversibly separated from the carriage wall 24 and fixed thereto by means of the clamping screw 34. In particular, the fastening apparatus 30 can be secured in defined, reproducible positions relative to the carriage wall 24. In particular, the defined, reproducible position relative to the carriage wall 24 is a position in which the carriage wall 24 forms an anti-contact guard that rises vertically from the carriage wall 24. This vertical protrusion on the carriage wall is simultaneously used as a vertical stop for the fastening apparatus 30.

As is clearly visible, the angle $\alpha$, i.e. the inclination angle of the bearing surface 28 and thus also the cutting angle at which discs of material to be cut can be cut off, can be adjusted by securing the fastening apparatus 30 when the carriage wall 24 is in various positions, depending on the tilt desired for the bearing surface 28.

It can be seen on the basis of FIG. 3 in particular that the holder 26 for material to be cut is flush with the blade-side edge of the carriage 20. For this purpose, the bearing surface side faces 29 are beveled relative to a bearing surface bottom 38 of the bearing surface 28 depending on the angle $\alpha$ or typically expected values for this angle.

Figure 4:
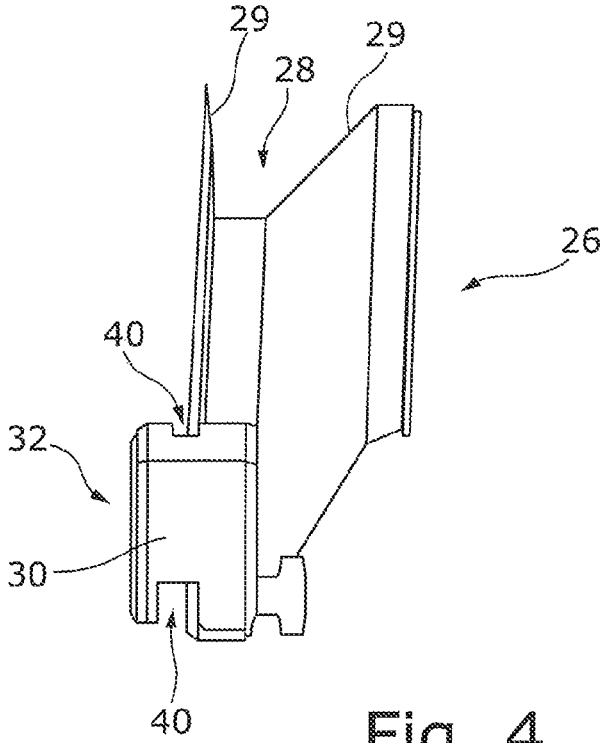
FIG. 4 is a perspective view from below of the holder for material to be cut from FIG. 1.

FIG. 4 is a perspective view from below of the holder 26 for material to be cut from FIG. 1.

Firstly, it can be seen that the bearing surface 28 thereof is formed as a sheet, in particular a metal sheet. The bearing surface 28 is trough-shaped. Its trough-shaped, in particular U-shaped, cross section is produced by means of press forming. The distance between the two side faces 29 of the bearing surface 28 and the inclination angle of said faces are adjusted to typically expected dimensions of the material to be cut.

The fastening apparatus 30 is rigidly connected to the rest of the holder 26 for material to be cut. Overall, therefore, the holder 26 for material to be cut is formed in one piece.

Furthermore, in the region of its clamping portion 32, the fastening apparatus 30 comprises fastening recesses 40 that are formed as slots and allow the holder 26 for material to be cut to be fastened to the carriage wall 24 in an exact fit (see FIG. 1).

Figure 5:
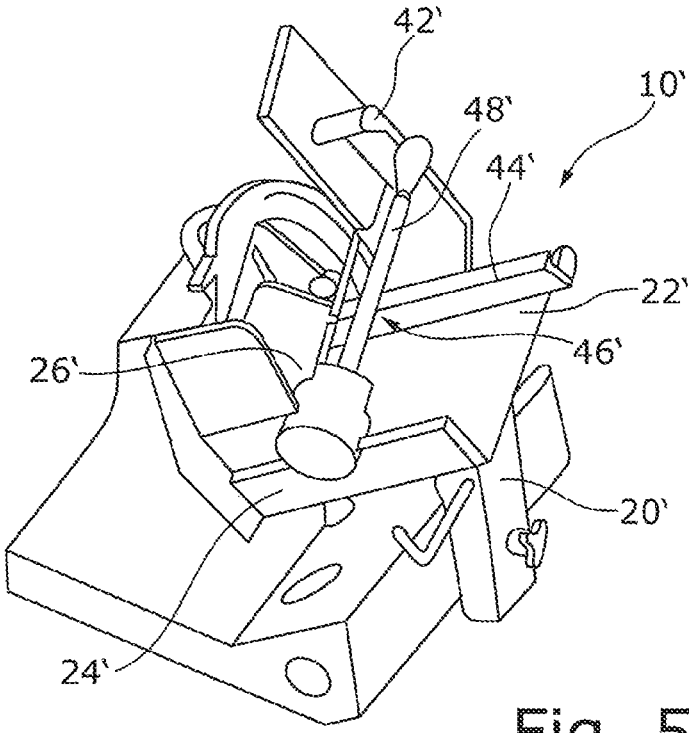
FIG. 5 is a perspective view of an embodiment of the disc cutting machine according to the invention, formed as an oblique cutter and comprising a holder for material to be cut fitted on a carriage.

FIG. 5 is a perspective view of another embodiment of the disc cutting machine 10' according to the invention, comprising a carriage 20', to the carriage wall 24 of which a holder 26' for material to be cut is fitted. The carriage 20' also comprises a carriage plate 22'.

The disc cutting machine 10', and in particular its holder 26' for material to be cut, largely correspond to the disc cutting machine 10 from FIG. 1, and so only specific features and differences compared with said embodiment will be described below.

The disc cutting machine 10' is formed as an oblique cutter. Unlike the carriage 20 from FIG. 1, its carriage 20' comprises a scraps holder 42' that is arranged on a front carriage wall 44' of the carriage 20'.

The holder 26' for material to be cut has an element holder 46', which comprises an element holder arm 48' that is adjustable in length, in particular is telescopic. The element holder 46' forms a securing apparatus for securing the scraps holder 42'. It secures the scraps holder 42' in a particular, predefinable rest position (an in particular substantially vertical position in this embodiment) when the holder 26' for material to be cut is mounted. In particular, the element holder 46' supports the scraps holder 42' on the carriage wall 24' by means of its element holder arm 48'.

The element holder 46' can be adapted to different disc cutting machines by altering the length of the element holder arm 48'.

Figure 6:
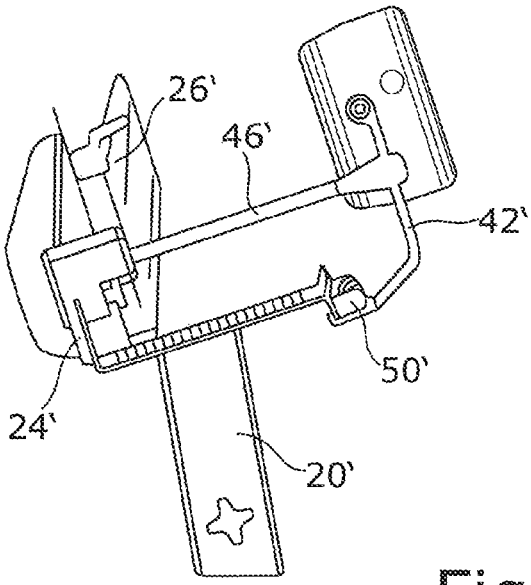
FIG. 6 is a perspective side view of the carriage together with the holder for material to be cut from FIG. 5.

FIG. 6 shows the carriage 20' together with the holder 26' for material to be cut in a perspective side view looking towards the circular blade of the disc cutting machine 10' from FIG. 5.

It can be seen that the carriage 20' comprises a rail 50' on which the scraps holder 42' is slidably arranged. As a result, the scraps holder 42' can be slid into a position that is suitable for being secured by the element holder 46'.

Figure 7:
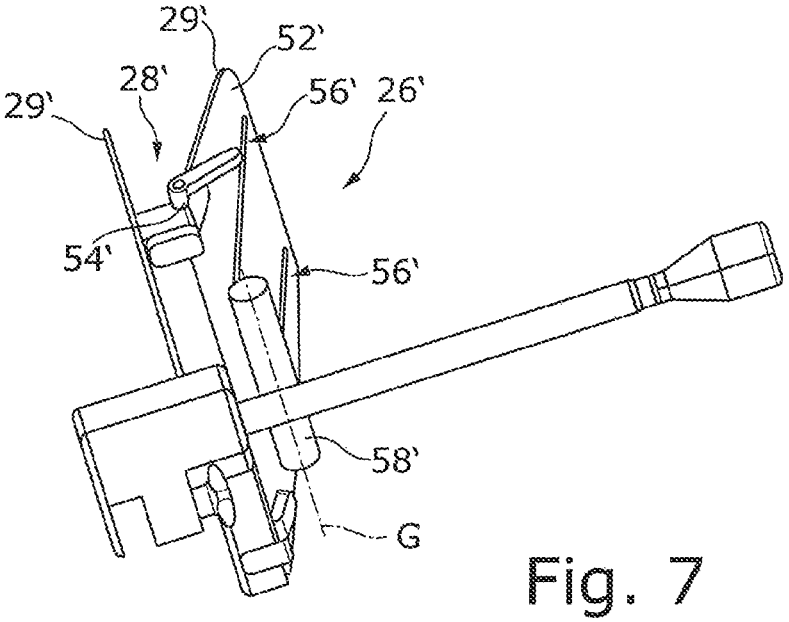
FIG. 7 is a perspective view from below of the holder for material to be cut of the disc cutting machine from FIG. 5.
Figure 8:
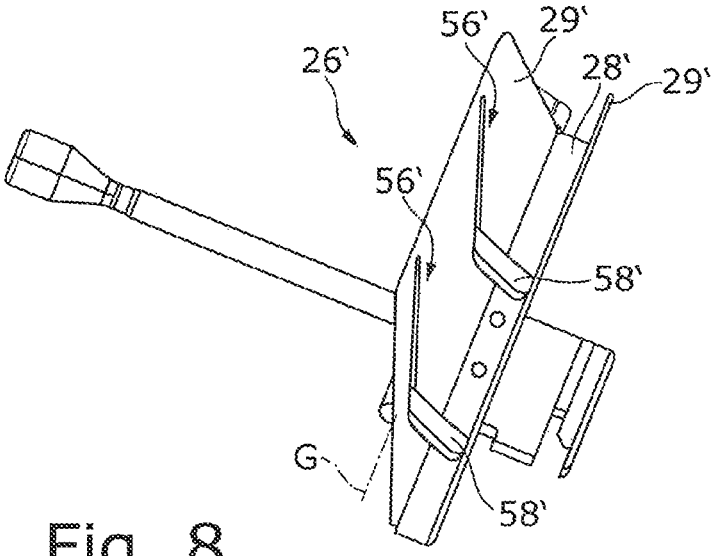
FIG. 8 is a perspective plan view of the holder for material to be cut of the disc cutting machine from FIG. 5.

Lastly, FIGS. 7 and 8 are a perspective side view (see FIG. 7) and a perspective plan view (see FIG. 8) of the holder 26' for material to be cut from the embodiment of the disc cutting machine 10' according to FIG. 5.

It can be seen in particular on the basis of FIG. 7 that the bearing surface 28' of the holder 26' for material to be cut comprises two bearing surface side faces 29', one of which is formed as a movable wall portion 52'. By means of a wall adjuster 54' formed as a securable hinge, the movable wall portion 52' can be tilted and thus adjusted. The geometry of the bearing surface 28' can thus be adapted to the material being cut at that time, in particular to the cross section thereof.

In addition, by means of side face through-openings 56', steadies 58' pass through one of the bearing surface side faces 29'. By means of a hinge, the steadies 58' can be tilted about an axis G parallel to the bearing surface bottom of the bearing surface 28'. As a result, the steadies 58' can secure material being cut in the bearing surface 28' or relative to the carriage plate 22' (see FIG. 5). The steadies can also be shifted up or down in the side face through-openings. This is done by sliding the handle on the rear side (in which the axis G' is drawn in the embodiment from FIG. 5) accordingly.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

10, 10' Disc cutting machine
12 Cutting device
14 Blade motor
16 Circular blade
18 Control unit
20, 20' Carriage
22, 22' Carriage plate
24, 24' Carriage wall
26, 26' Holder for material to be cut
28, 28' Bearing surface
29, 29' Bearing surface side faces
30 Fastening apparatus
32 Clamping portion
34 Clamping screw
36 Actuating head
38 Bearing surface bottom
40 Fastening recesses
42' Scraps holder
44' Front carriage wall
46' Element holder
48' Element holder arm
50' Rail
52' Movable wall portion
54' Wall adjuster
56' Side face through-openings
58' Steady
α Angle
E Plane
G Axis
R Cutting direction
S Carriage plane
X Axis of rotation

What is claimed is:

1. An electrically powered disc cutting machine for cutting off discs from material to be cut, the electrically powered disc cutting machine comprising:

a cutting device having a circular blade, the circular blade being configured to rotate in a cutting plane about an axis of rotation perpendicular to the cutting plane and to be driven by a blade motor, the cutting device comprising:

a carriage, the carriage being configured to carry:

a carriage plate in a carriage plane perpendicular to the cutting plane; and at least one carriage wall that protrudes from the carriage plane; and a holder for holding the material to be cut, the holder having a bearing surface configured to receive the material to be cut, wherein the holder for material to be cut comprises a fastening apparatus, the fastening apparatus being configured to fasten the holder for the material to be cut to the carriage wall flush with a blade-side edge of the carriage, the fastening apparatus being configured to secure the holder for the material to be cut in a defined, reproducible position relative to the carriage wall such that an inclination angle of the bearing surface is <90° relative to the cutting plane.

2. The electrically powered disc cutting machine according to claim 1, wherein the fastening apparatus is configured to allow the holder for the material to be cut to be fastened to the carriage wall in a reversible manner that is reproducible during operation in terms of the relative position of the holder for material to be cut to the carriage wall, and to allow the holder for material to be cut to be removed from the carriage wall.

3. The electrically powered disc cutting machine according to claim 2, wherein the fastening apparatus is configured so as to allow the holder for material to be cut to be fastened in different, selectable relative positions of the holder for material to be cut to the carriage wall, so as to set different angles at which the material being cut can be brought closer to the circular blade obliquely to the axis of rotation.

4. The electrically powered disc cutting machine according to claim 2, wherein the fastening apparatus comprises a clamping portion for the reversible and reproducible fastening.

5. The electrically powered disc cutting machine according to claim 4, wherein the reversible and reproducible fastening is by way of a press fit using a clamping screw.

6. The electrically powered disc cutting machine according to claim 5, wherein the clamping screw comprises a knurled thumb screw.

7. The electrically powered disc cutting machine according to claim 1, wherein the holder for material to be cut is fastenable to the carriage wall without using tools.

8. The electrically powered disc cutting machine according to claim 1, wherein the holder for material to be cut, in particular the bearing surface for receiving the material, comprises one or more devices configured to secure the material to be cut relative to the carriage plate.

9. The electrically powered disc cutting machine according to claim 8, wherein the one or more devices configured to secure the material to be cut relative to the carriage plate comprise one or more steadies.

10. The electrically powered disc cutting machine according to claim 1, wherein the fastening apparatus is attached to a rear carriage wall arranged behind the axis of rotation in the cutting direction.

11. The electrically powered disc cutting machine according to claim 1, wherein the bearing surface of the holder for material to be cut, which surface is configured to receive material, is trough-shaped.

12. The electrically powered disc cutting machine according to claim 11, wherein the trough-shaped bearing surface comprises a U-shaped or V-shaped cross section.

13. The electrically powered disc cutting machine according to claim 1, wherein the holder for material to be cut or at least the bearing surface thereof is comprised of shaped sheet metal.

14. The electrically powered disc cutting machine according to claim 13, wherein the holder for material to be cut or at least the bearing surface thereof is comprised of one piece.

15. The electrically powered disc cutting machine according to claim 1, wherein the bearing surface comprises at least one movable wall portion that is adjustable.

16. The electrically powered disc cutting machine according to claim 15, wherein the at least one movable wall portion is configured such that geometry of the bearing surface is adaptable to a cross section of the material being cut.

17. The electrically powered disc cutting machine according to claim 15, wherein the at least one movable wall portion is tiltable and/or displaceable.

18. The electrically powered disc cutting machine according to claim 1, wherein the holder for material to be cut comprises a securing apparatus, in particular an element holder, configured to secure an element of the carriage, in particular a scraps holder.

19. The electrically powered disc cutting machine according to claim 18, wherein the scraps holder is securable when it is in a particular position on a rail configured to slide the scraps holder.

20. The electrically powered disc cutting machine according to claim 1, wherein the disc cutting machine comprises a vertical cutter or an oblique cutter.

* * * * *